United States Patent [19]

Matsui et al.

[11] Patent Number: 4,683,713

[45] Date of Patent: Aug. 4, 1987

[54] BOBBIN FEEDING SYSTEM

[75] Inventors: Isamu Matsui; Hidetoshi Kimura, both of Kyoto; Kazuo Nakanishi, Uji, all of Japan

[73] Assignee: Murata Kikai Kabushiki Kaisha, Kyoto, Japan

[21] Appl. No.: 863,955

[22] Filed: May 16, 1986

[30] Foreign Application Priority Data

May 20, 1985 [JP] Japan ..... 60-109072

[51] Int. Cl.[4] ..... D01H 9/02; B65H 54/22

[52] U.S. Cl. ..... 57/281; 57/276; 242/35.5 R

[58] Field of Search ..... 57/265, 270, 276, 281; 209/552, 927; 242/35.5 R, 36, 41, 18 R

[56] References Cited

U.S. PATENT DOCUMENTS

| | | | |
|---|---|---|---|
| 3,054,249 | 9/1962 | Bahnson | 57/270 X |
| 3,410,406 | 1/1968 | Tsuda et al. | 209/927 X |
| 4,181,228 | 1/1980 | Hashimoto | 57/281 X |
| 4,508,227 | 4/1985 | Kupper | 209/927 |
| 4,566,263 | 1/1986 | Miyazaki et al. | 57/281 X |
| 4,571,931 | 2/1986 | Kupper | 209/927 X |

*Primary Examiner*—Donald Watkins

*Attorney, Agent, or Firm*—Spensley, Horn, Jubas & Lubitz

[57] ABSTRACT

A system comprising spinning-bobbin feeding lines and empty-bobbin feeding lines connecting spinning frames with winders is provided, in which the feeding lines are provided in a feeding groove provided below a floor surface on which the machine bases are disposed, and the spinning-bobbin feeding lines are separate from the empty-bobbin feeding lines only in the vertical direction.

8 Claims, 8 Drawing Figures

BOBBIN FEEDING SYSTEM

FIELD OF THE INVENTION AND RELATED ART STATEMENT

The present invention relates to a system for feeding bobbins, and particularly to a system for feeding spinning bobbins and empty bobbins between spinning frames and winders.

As a system for feeding spinning bobbins, namely, bobbins on which a yarn produced by a spinning frame has been wound, to an automatic winder for the next step and feeding empty bobbins discharged from the winder to the spinning frame, a system is disclosed in Japanese Patent Application Laid-Open No. 59-17464 (1984). In the system, a spinning frame and a winder are connected by a spinning-bobbin feeding line and an empty-bobbin feeding line, and the system is suitable for winding a plurality of kinds of yarns by a single winder. Independent trays each provided with a peg are used as bobbin feeding media, and bobbins supported upright on the trays are supplied to the winder and returned to the spinning frame.

In the abovementioned system, the spinning-bobbin feeding line and the empty-bobbin feeding line connecting the spinning frame side with the winder side require respective belt conveyors for exclusive use as well as respective driving motors for the conveyors and the like. Namely, since the filled bobbins and the empty bobbins are to be fed in opposite directions, two conveyors are disposed in parallel with each other and moved rotatorily in the opposite directions to feed the bobbins in predetermined directions. Laying out the conveyors in crossed directions requires a large space for exclusive use for the feeding lines, and hinders free movements of the operator, various working trucks or the like.

OBJECT AND SUMMARY OF THE INVENTION

It is an object of the present invention to reduce a space required for feeding bobbins in the horizontal direction in a spinning mill.

The present invention provides a system in which spinning-bobbin feeding lines and empty-bobbin feeding lines connecting spinning frames with winders are provided in a feeding groove provided below a floor surface on which the spinning frames and the winders are disposed, and the spinning-bobbin feeding lines are separate from the empty-bobbin feeding lines only in the vertical direction.

BRIEF DESCRIPTION OF THE DRAWINGS

FIGS. 1 and 2 are layout plans showing positional relationships of a plurality of winders and spinning frames as well as an embodiment of a bobbin feeding system, wherein FIG. 1 is a plan showing the spinning-bobbin feeding lines, and FIG. 2 is a plan showing the empty-bobbin feeding lines;

DETAILED DESCRIPTION OF PREFERRED EMBODIMENT

Figure 1:
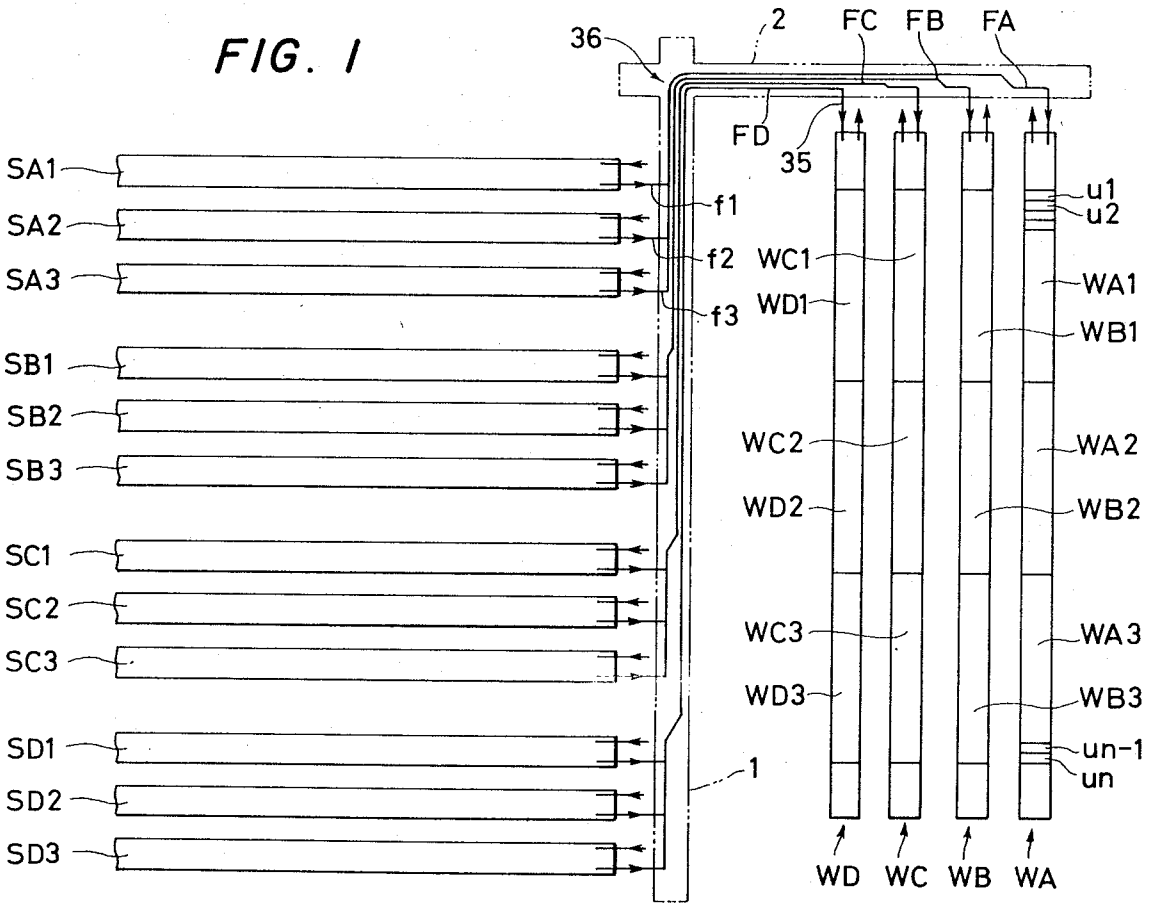

An embodiment of the present invention will now be explained below while referring to the drawings.

FIG. 1 shows an example of the layout of spinning frames, winders and bobbin feeding lines. In the present embodiment, each winder is substantially divided into three sections for winding three kinds of yarns, with a single spinning frame corresponding to each section, and four such winders and a total of 12 spinning frames are provided.

Namely, the winder WA comprises a multiplicity of winding units $U_1$ to $U_n$ disposed in a row, and the winding units are divided into groups each consisting of a plurality of units, each of the groups constituting a section for winding a single kind of yarn. The winder WA is substantially divided into three sections WA1, WA2, and WA3 for winding three kinds of yarns.

In parallel with the winder WA are provided winders WB, WC and WD, which are similarly divided into three winding sections WB1, WB2, WB3, WC1, WC2, WC3, and WD1, WD2, WD3.

Figure 2:
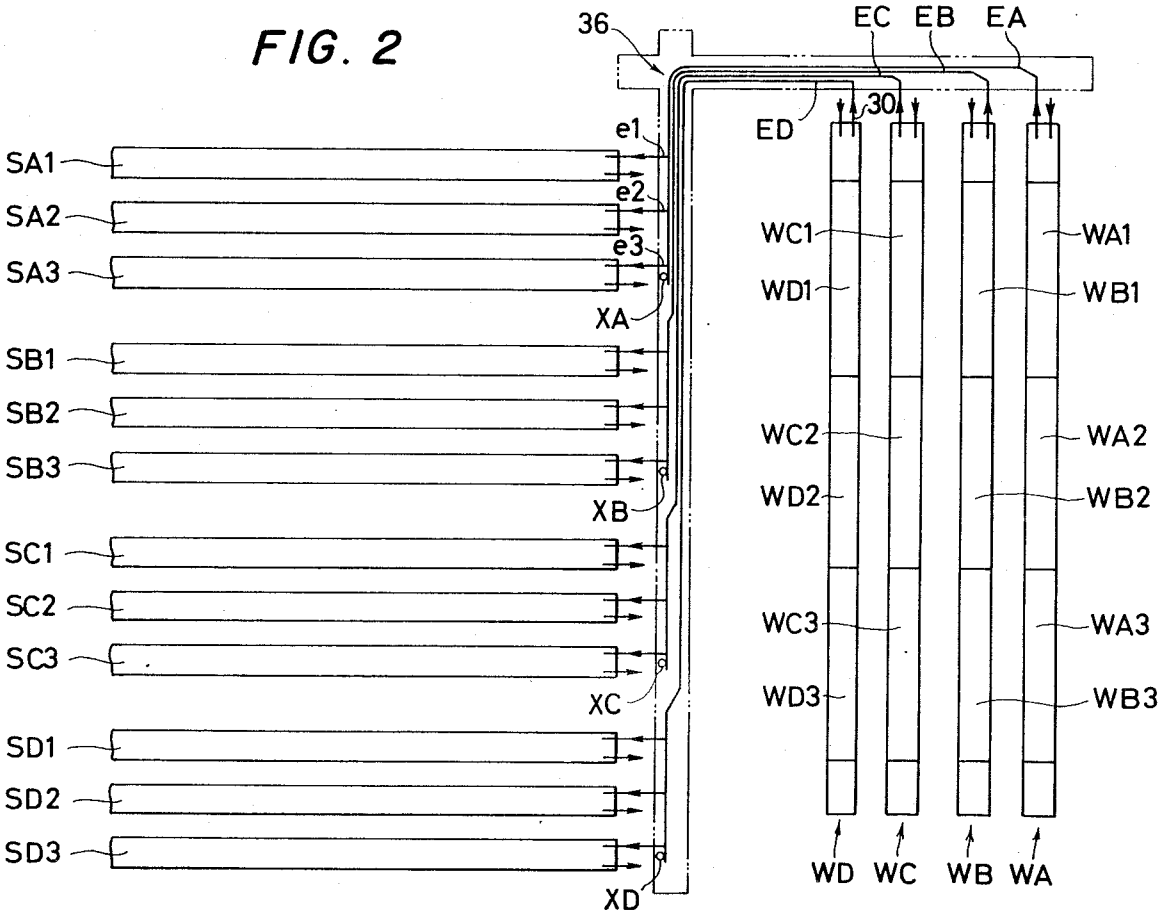

On the other hand, spinning frames SA1, SA2 and SA3 for producing the yarns to be wound by the sections WA1–WA3 of the winder WA are provided in parallel with each other, and the winder WA is connected with the spinning frames SA1–SA3 by a spinning-bobbin feeding line FA and an empty-bobbin feeding line EA shown in FIG. 2.

Similarly, the winder WB is connected with spinning frames SB1–SB3 by a spinning-bobbin feeding line FB and an empty-bobbin feeding line EB, the winder WC is connected with spinning frames SC1–SC3 by a spinning-bobbin feeding line FC and an empty-bobbin feeding line EC, and the winder WD is connected with spinning frames SD1–SD3 by a spinning-bobbin feeding line FD and an empty-bobbin feeding line ED.

As will be described later, the feeding lines FA–FD and EA–ED are provided in feeding grooves 1, 2 provided below the floor surface on which the winders and the spinning frames are disposed, namely, under the floor. In other words, the regions delinerated by two-dotted lines 1, 2 in FIGS. 1 and 2 are underground grooves.

Further, to the spinning-bobbin feeding line FA are joined spinning-bobbin delivery lines f1, f2 and f3 extending along machine bases of the spinning frames SA1–SA3, and the same applies to the other lines FB, FC and FD. In addition, in FIG. 2, from the empty-bobbin feeding line EA are branched empty-bobbin receiving lines e1, e2 and e3, and a bobbin kind discriminator is provided on the immediate upstream of each branching position, whereby empty bobbins discharged from the section WA1 on the winder side are securely returned to the corresponding spinning frame SA1, empty bobbins from the section WA2 are returned to the spinning frame SA2, and empty bobbins from the section WA3 are returned to the spinning frame SA3. Incidentally, at an end part of the feeding line EA is provided a box XA for containing the empty-bobbins omitted in sorting.

The abovementioned construction applies also to the other feeding lines FB–FD and EB–ED.

Figure 7:
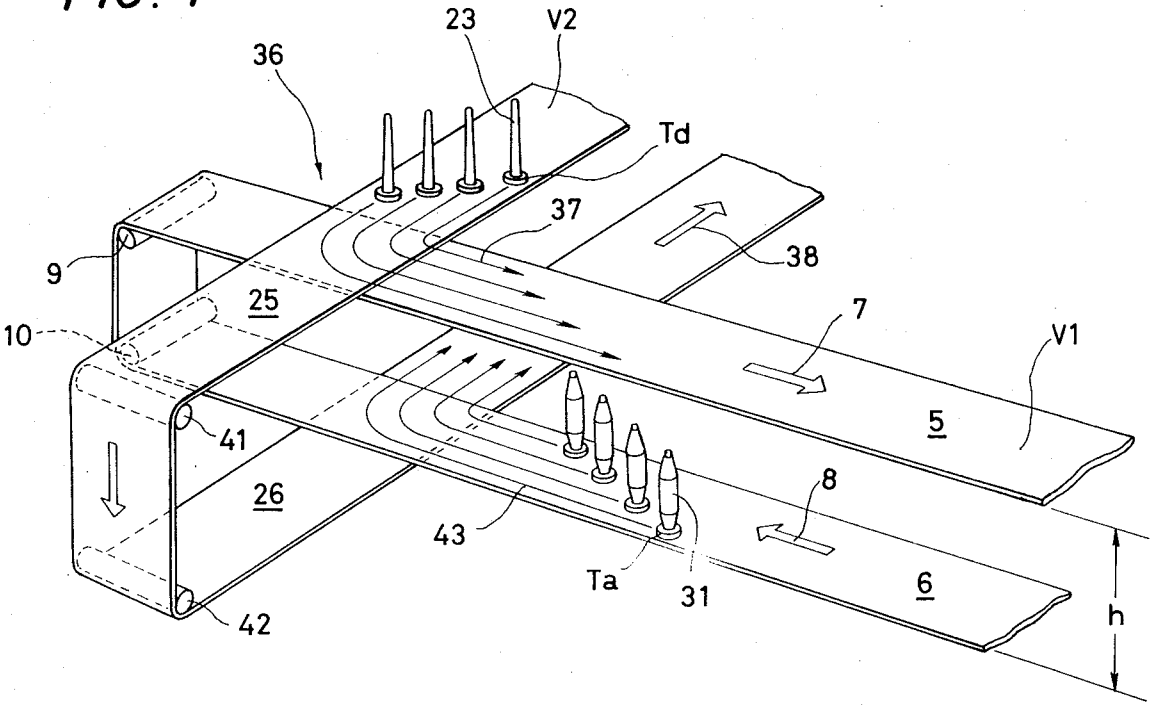
FIG. 7 is a perspective view showing the crossing condition of belts at a corner part.

Connecting parts of the spinning frames with the spinning-bobbin feeding lines and the empty-bobbin feeding lines will now be explained while referring to FIGS. 3 and 4, which illustrate the parts for the spinning frame SA1. In the direction orthogonal to the longitudinal direction of the spinning frame SA1, a feeding groove 1 having a recessed cross-sectional shape is provided below the floor surface 3, and a lid plate 4 such as a steel plate is placed at an upper opening, thereby defining a bobbin feeding groove. In the feeding groove 1, the spinning-bobbin feeding line FA and the empty-bobbin feeding line EA are provided in the state of being separate from each other only in the vertical direction. Namely, the lines FA and EA are constituted of parts of a conveyor belt with a width (a) disposed over the range of all the spinning frames SA-1-SD3. In the example shown, the upper flat 5 of the conveyor belt is used as the empty-bobbin feeding line EA, and the lower flat 6 is used as the spinning-bobbin feeding line FA. Namely, as shown in FIG. 7, of the conveyor belt V1 moved rotatorily along the spinning frames, the upper flat 5 moved in the direction of arrow 7 is used as the empty-bobbin feeding lines, and the lower flat 6 moved in the direction of arrow 8 is used as the spinning-bobbin feeding lines. Therefore, a spacing (h) not less than the maximum length of various bobbins is set between the upper flat 5 and the lower flat 6 by setting the fitting positions of rollers 9 and 10. More accurately, the spacing (h) is naturally set in consideration of the height of the trays T on which the bobbins are errected to be fed.

Figure 3:
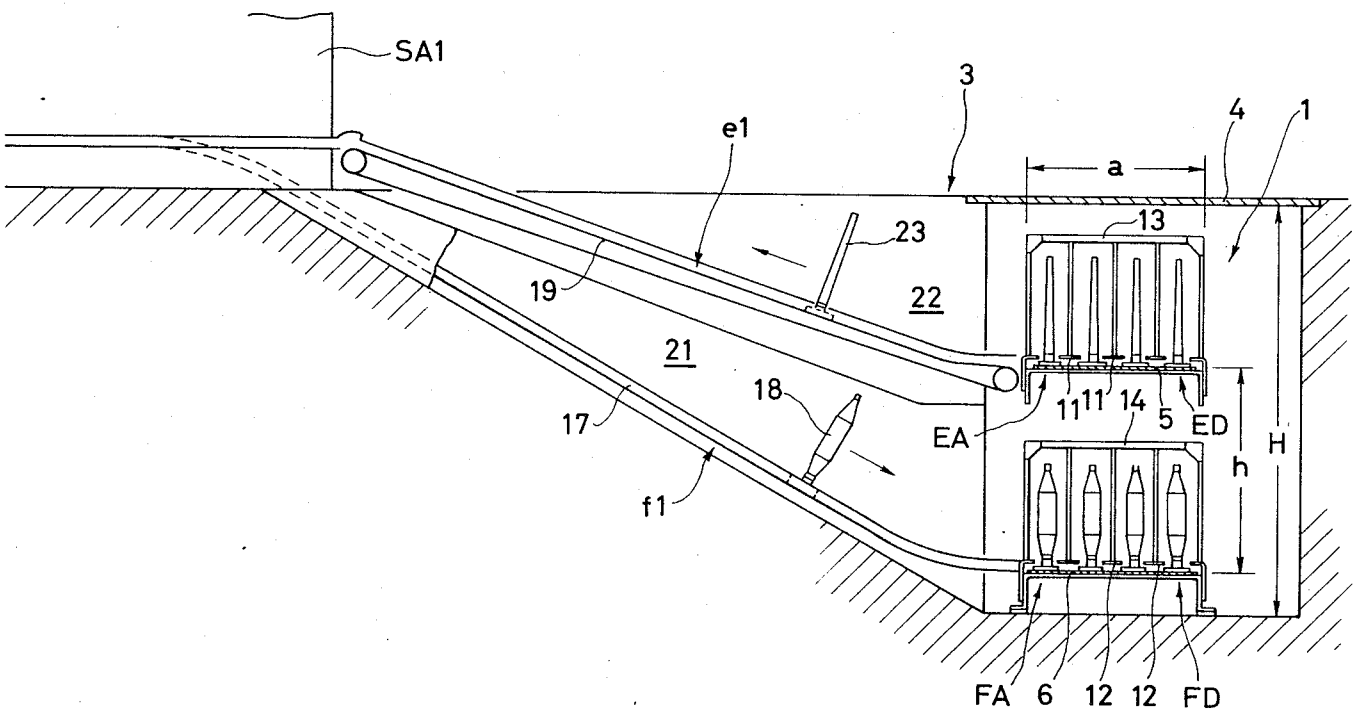
FIG. 3 is a cross-sectional view showing the condition of feeding the bobbins on the spinning frame side.
Figure 4:
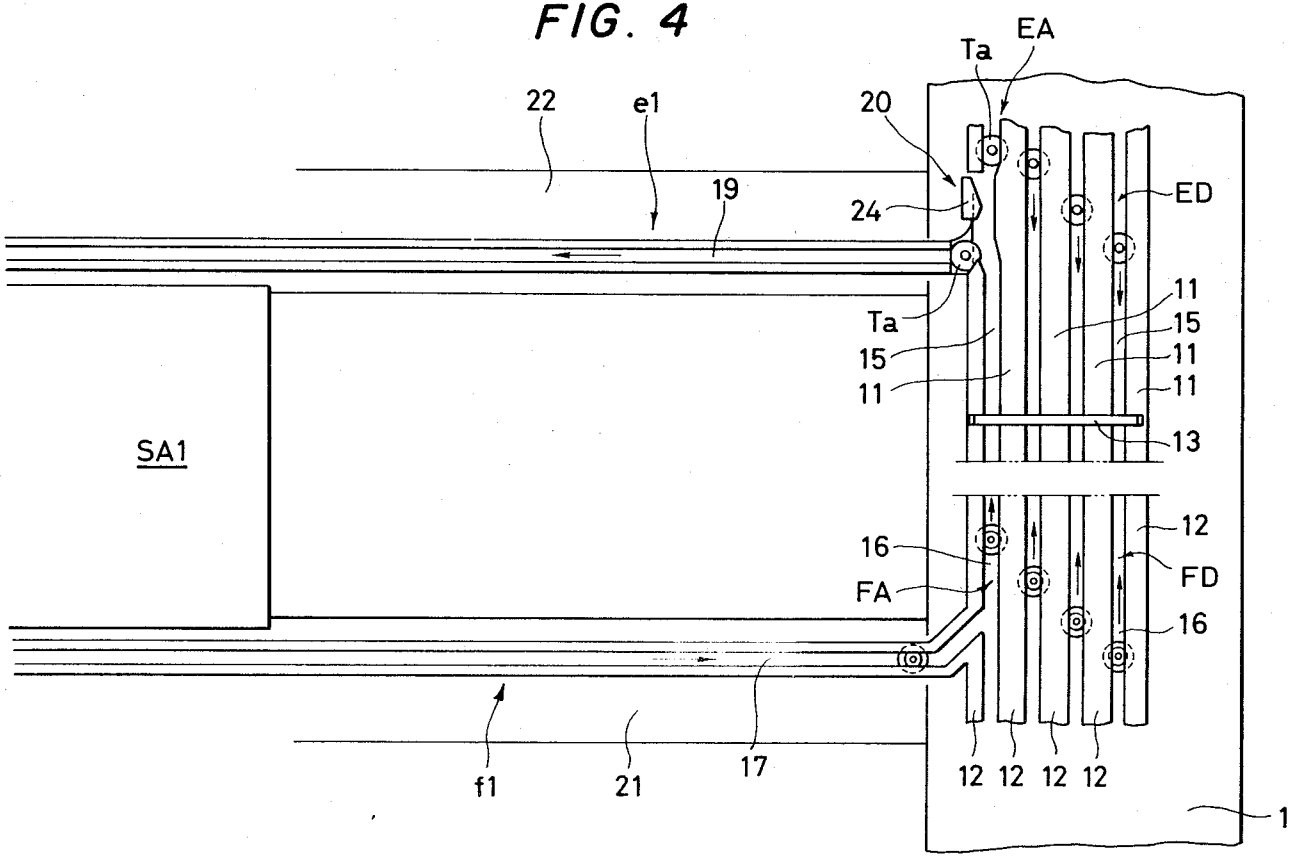
FIG. 4 is a plan view of the same condition.

As shown in FIGS. 3 and 4, guide plates 11, 12 for defining passages for feeding the trays are provided above the conveyor 5 and supported by frames 13, 14 or the like, with a predetermined spacing from the upper surface of the conveyor, and guide grooves 15, 16 form the bobbin feeding lines FA-FD. The empty-bobbin feeding lines EA-ED also have a similar construction.

Further, the spinning frame SA1 is connected with the spinning-bobbin feeding line FA by a slant chute 17, on which the spinning-bobbin 18 slides under its own weight down onto the feeding line FA. On the other hand, between the empty-bobbin feeding line EA and the spinning frame SA1 is provided a receiving line consisting of a slant conveyor 19. As shown in FIG. 4, an empty bobbin 23 to be returned to the spinning frame SA1 is selected, as one body with the tray, by a sorter 20 provided on the immediate upstream of the branching position, is transferred onto the conveyor 19 and returned to the spinning frame SA1. Accordingly, slant grooves 21, 22 for the chute 17 and the slant conveyor 19 are provided in continuity with the feeding groove 1.

On the empty-bobbin feeding conveyor EA, the three kinds of the empty bobbins discharged from the sections WA1, WA2 and WA3 of the winder WA are fed in a random order, and, as shown in FIG. 4, the bobbin sorters 20 are provided on the immediate upstream of each branching position. As the sorter 20, various devices can be used. In the present example, there is used a sorter consisting of a tray T provided with a discriminating groove and a gauge corresponding to the discriminating groove position, disclosed in the present applicant's Japanese Patent Application Laid-Open No. 60-67370 (1985). Numeral 24 in FIG. 4 denotes a fixed gauge provided at a position for entering a discriminating groove formed in a tray Ta on which an empty bobbin to be returned to the relevant spinning frame is errected. Naturally, a sorter may be used which comprises a mark sensor for detecting the color of the tray or reading a bar code or the like and a movable gate opened or closed in accordance with a signal from the sensor.

Figure 5:
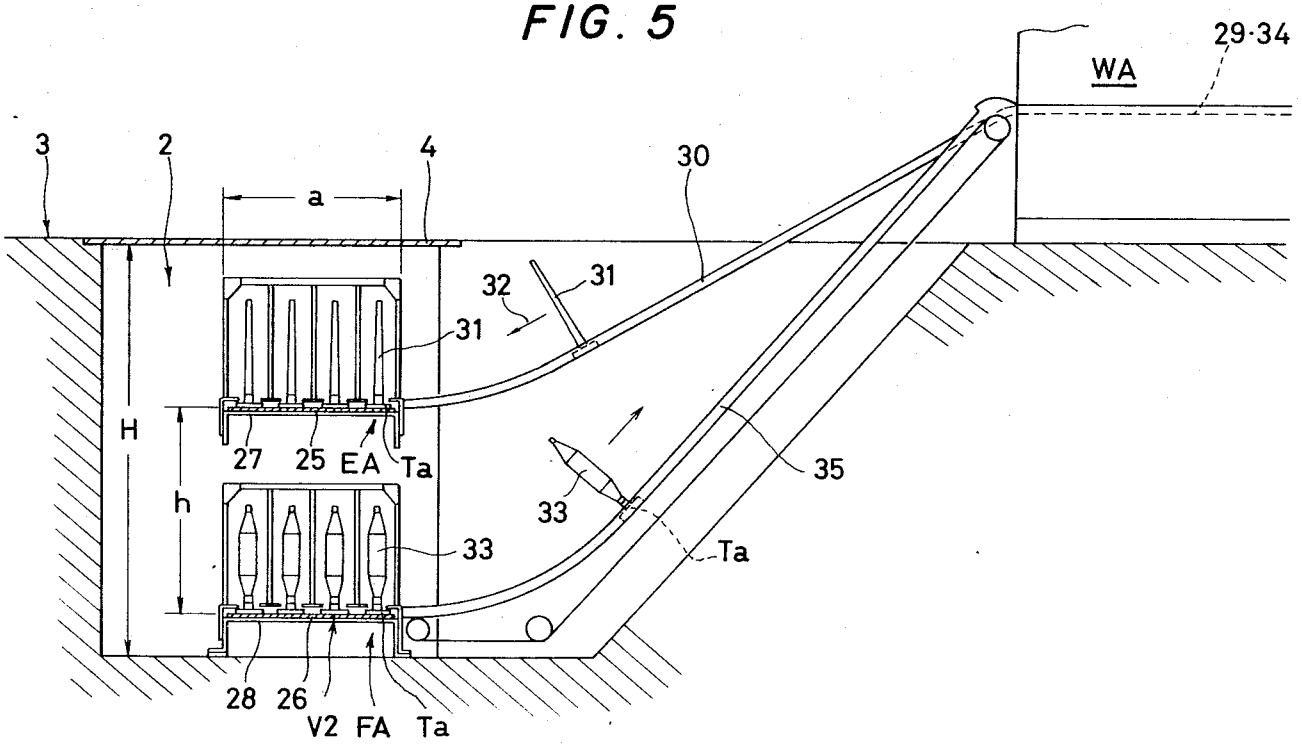
FIG. 5 is a cross-sectional view showing the condition of feeding the bobbins on the winder side.
Figure 6:
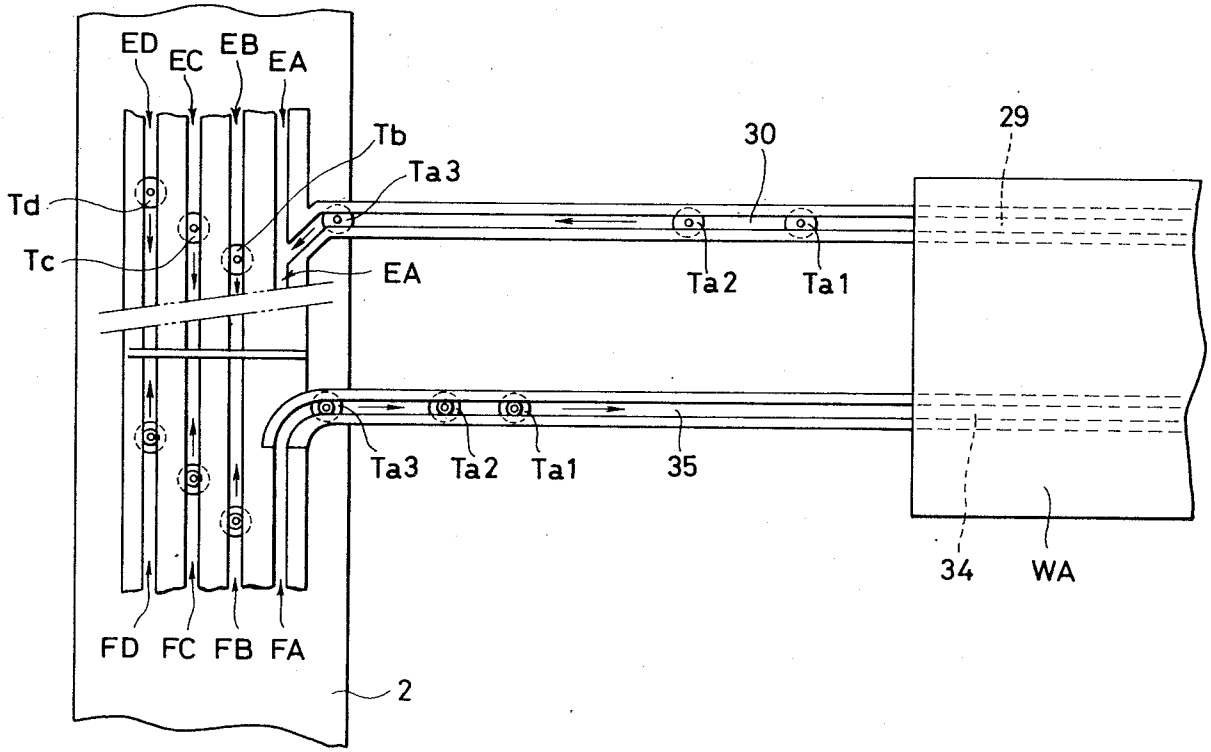
FIG. 6 is a plan view of the same condition.

FIGS. 5 and 6 show the connecting parts of the winder WA with the feeding lines FA and EA. In a manner similar to that on the spinning frame side, a loop form conveyor V2 having an upper flat 25 and a lower flat 26 with a spacing (h) therebetween is disposed in the feeding groove 2 having a depth H, over the range of all the winders WA-WD. Numerals 27 and 28 denote guide plates for preventing the conveyor from sagging.

Between the empty-bobbin feeding line EA for the winder WA and an empty-bobbin returning passage 29 on the winder side is provided a slant chute 30, on which a tray with an empty bobbin 31 errected thereon slides under its own weight in the direction of arrow 32 down onto the conveyor flat 25. On the other hand, a tray Ta with a spinning-bobbin 33 thereon fed from the spinning frame side is fed in the direction of an arrow by a slant conveyor 35 provided between the conveyor flat 26 and a filled-bobbin supplying passage 34 on the winder side.

Incidentally, three kinds of spinning-bobbins are present at random on the spinning-bobbin feeding line FA, and the trays (Ta1, Ta2 and Ta3 in FIG. 6) with the filled bobbins errected thereon pass through the connecting part of the feeding line FA and the slant conveyor 35 without being sorted, and they are sorted immediately before reaching each of the sections WA1-WA3 of the winder WA. The sorting of the bobbins in the winder region is also performed by the abovementioned discriminating grooves and discriminating gauges shown in FIG. 4.

Figure 8:
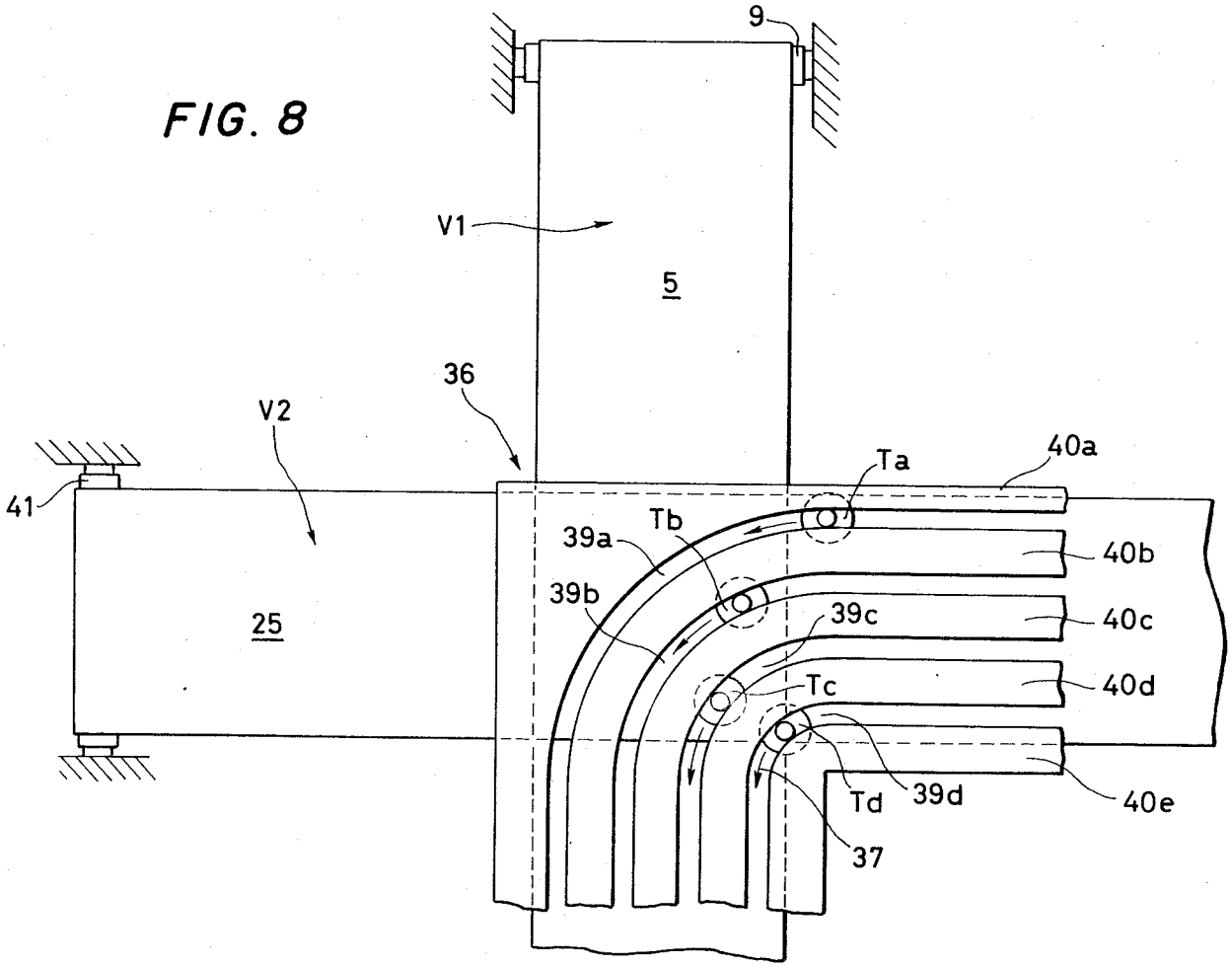
FIG. 8 is a plan view of the same condition.

In the abovementioned embodiment, as shown in FIGS. 1 and 2, in the case where the spinning-bobbin feeding lines FA-FD and the empty-bobbin feeding lines EA-ED have a corner part 36, a crossing part of the conveyors at the corner part 36 is constructed as shown in FIGS. 7 and 8 in order to smoothly transferring the trays between the conveyors. Namely, for the empty bobbins 23 on the upper flat 25 of the conveyor V2 extending on the winder side to be transferred onto the upper flat 5 of the conveyor V1 extending on the spinning frame side, the upper flat 25 on the winder side is disposed above the upper flat 5 on the spinning frame side, and the empty bobbins are transferred along arrows 37. On the other hand, for spinning-bobbins 31 to be fed in directions of arrows 8 and 38, the lower flat 6 of the conveyor V1 on the spinning frame side is disposed above the lower flat 26 of the conveyor V2 on the winder side, and the spinning-bobbins 31 are transferred in the direction of arrows 43. At the corner part, as shown in FIG. 8, arcuate guide grooves 39*a*-39*d* are formed by guide plates 40*a*-40*e*, and the trays T*a*-T*d* are deflectedly fed by the moving forces of the belts.

In the feeding system as described above, the spinning bobbins delivered from the spinning frames and the empty bobbins discharged from the winders are fed through the feeding groove provided under the floor by the conveyor flats which are separate from each other only in the vertical direction, and, accordingly, the feeding is realized in a three-dimensional manner, and the space required for the feeding is reduced.

Particularly, in the system as shown in FIG. 1, a total of 12 kinds of bobbins are fed along the feeding lines FA-FD. Thus, the system is convenient for feeding such an extremely large number of kinds of bobbins.

Further, in the abovementioned embodiment, the spinning bobbins and the empty bobbins are fed respectively by the face side and the back side of the same conveyor belt, so that the feeding area is reduced to ½ of that required in the case of using separate conveyors, and only one drive source is required, resulting in an extremely compact feeding system.

Moreover, although the embodiment shown in FIGS. 3 and 5 has the empty-bobbin feeding line at the upper stage and the spinning-bobbin feeding line at the lower stage, the reverse positional relationship can also be adopted, naturally.

As has been described above, according to the present invention, a system comprising spinning-bobbin feeding lines and empty-bobbin feeding lines connecting spinning frames with winders is provided, in which the feeding lines are provided in a feeding groove provided below a floor surface on which the machine bases are disposed, and the spinning-bobbin feeding lines are separate from the empty-bobbin feeding lines only in the vertical direction; accordingly, the space required for feeding in the horizontal direction is reduced, and the operators can move freely on the floor surface which is above the feeding lines. Therefore, the system is particularly effective in a spinning mill in which a large number of machine bases are installed.

What is claimed is:

1. A system for feeding bobbins, comprising:

one or more spinning bobbin feeding lines and one or more empty-bobbin feeding lines connecting one or more spinning frames with one or more winders, said spinning frames and said winders being supported by a floor surface, a feeding groove provided substantially below said floor surface, said feeding lines being disposed in said feeding groove, said spinning bobbin feeding lines being separate from said empty-bobbin feeding lines in the vertical direction, an endless conveyor belt supported by rollers to thereby define an upper flat and a lower flat of the endless conveyor belt, said upper flat and said lower flat being spaced by a distance not less than the maximum length of said bobbins.

2. A system as claimed in claim 1, wherein said upper flat of the conveyor belt is used as an empty-bobbin feeding line and said lower flat of the conveyor belt is used as a spinning-bobbin feeding line.

3. A system as claimed in claim 2, wherein said spinning bobbins and empty bobbins are erected and transported on trays, further comprising: guide plates provided above the conveyor belt for guiding the trays, and frames for supporting the guide plates at a predetermined spacing from the upper surface of the conveyor belt.

4. A system as claimed in claim 3, further comprising:

a slant chute connecting a spinning frame with said spinning-bobbin feeding line said slant chute being disposed to enable the spinning bobbin to slide under its own weight down onto the feeding line, and a slant conveyor provided between said empty-bobbin feeding line and a spinning frame said slant conveyor being disposed to enable an empty bobbin and tray to be transferred onto the conveyor and returned to the spinning frame.

5. A system as claimed in claim 3, wherein guide plates for preventing the conveyor belt from sagging are provided under the upper flat and lower flat of said conveyor belt.

6. A system as claimed in claim 3, wherein the empty bobbin feeding line comprises:

a first conveyor belt associated with the winders, a second conveyor belt associated with the spinning frames, said first and second conveyor belts each having upper flats which intersect at a crossing location, wherein at said crossing location the upper flat of the first conveyor belt is disposed above the upper flat of the second conveyor belt, said guide plates forming arcuate guide grooves for guiding the trays so that the trays are directed in an arcuate path by the moving force of the intersecting belts.

7. A system as claimed in claim 3, wherein the spinning bobbin feeding line comprises:

a first conveyor belt associated with the spinning frames, a second conveyor belt associated with the winders, said first and second conveyor belts each having lower flats which intersect at a crossing location, wherein at said crossing location the lower flat of the first conveyor belt is disposed above the lower flat of the second conveyor belt, said guide plates forming arcuate guide grooves for guiding the trays so that the trays are directed in an arcuate path by the moving force of the intersecting belts.

8. A system for feeding bobbins, comprising:

a spinning frame disposed on a surface, a winder disposed on a surface, an endless conveyor belt supported on rollers disposed in spaced relationship, said endless conveyor belt having an upper surface and a lower surface separated by a distance not less than the maximum length of said bobbins, said lower surface serving as a spinning bobbin feeding line for feeding spinning bobbins from the spinning frame to the winder, said upper surface serving as an empty bobbin feeding line for feeding empty bobbins from the winder to the spinning frame, a feeding groove provided below the surfaces on which said spinning frame and said winder are disposed, at least a portion of said endless conveyor belt being disposed within said feeding groove.

* * * * *